US005117797A

United States Patent [19]

Telep et al.

[11] Patent Number: 5,117,797

[45] Date of Patent: Jun. 2, 1992

[54] PURGE VALVE

[75] Inventors: Robert J. Telep, Warren; William J. House, Sterling Heights, both of Mich.

[73] Assignee: Coltec Industries Inc., New York, N.Y.

[21] Appl. No.: 778,503

[22] Filed: Oct. 17, 1991

[51] Int. Cl.[5] ..... F02M 33/02

[52] U.S. Cl. ..... 123/520; 123/519; 251/30.01; 137/907

[58] Field of Search ..... 123/518, 519, 520, 521, 123/458; 251/30.01; 137/907

[56] References Cited

U.S. PATENT DOCUMENTS

| | | | |
|---|---|---|---|
| 4,059,081 | 11/1977 | Kayanuma | 123/521 |
| 4,180,234 | 12/1979 | Hertfeider | 137/907 |
| 4,194,526 | 3/1980 | Strömberg | 137/907 |
| 4,308,841 | 1/1982 | Kingsley | 123/520 |
| 4,503,887 | 3/1985 | Johnson et al. | 251/30.01 |
| 4,524,906 | 7/1985 | Kenyon et al. | 251/30.01 |
| 4,534,375 | 8/1985 | Fox | 137/907 |
| 4,535,805 | 8/1985 | Mertz | 251/30.01 |
| 4,628,887 | 12/1986 | Mitchell et al. | 123/520 |
| 4,708,316 | 11/1987 | Cook | 137/907 |
| 4,727,899 | 3/1988 | Massey et al. | 251/30.01 |
| 4,741,317 | 5/1988 | Yost | 123/520 |
| 4,809,667 | 3/1989 | Uranishi et al. | 123/520 |
| 4,944,276 | 7/1990 | House et al. | 123/520 |
| 4,951.637 | 8/1990 | Cook | 123/520 |
| 4,953,514 | 9/1990 | Beicht et al. | 123/521 |
| 5,054,455 | 10/1991 | Cook | 123/520 |

FOREIGN PATENT DOCUMENTS 5-41457 3/1982 Japan ..... 123/520

*Primary Examiner*—E. Rollins Cross
*Assistant Examiner*—Thomas N. Moulis
*Attorney, Agent, or Firm*—Howard S. Reiter

[57] ABSTRACT

A purge valve for controlling the flow of fuel vapor from a vehicle mounted fuel vapor storage canister to the intake manifold of the vehicle engine utilizes a solenoid actuated three-way valve to control the position of a flexible diaphragm of a flow metering valve to meter flow of fuel vapor at continuously variable rates in response to a solenoid actuating duty cycle signal from an electronic control unit. A diaphragm controlled vacuum regulator connected to the intake manifold maintains a flow chamber in the vacuum regulator at a substantially constant subatmospheric pressure into which the metered flow of fuel vapor is passed from a flow chamber of the metering valve at atmospheric pressure. The metering valve diaphragm shifts to adjust the flow rate in response to variations in the pressure differential between its flow chamber and a control chamber at the opposite side of the diaphragm. The metering valve control chamber is connected to the control port of the three-way duty cycle valve which alternately connects the control port to the flow chamber of the metering valve and to the flow chamber of the regulating valve to controllably vary the control chamber pressure in accordance with the duty cycle signal.

7 Claims, 1 Drawing Sheet

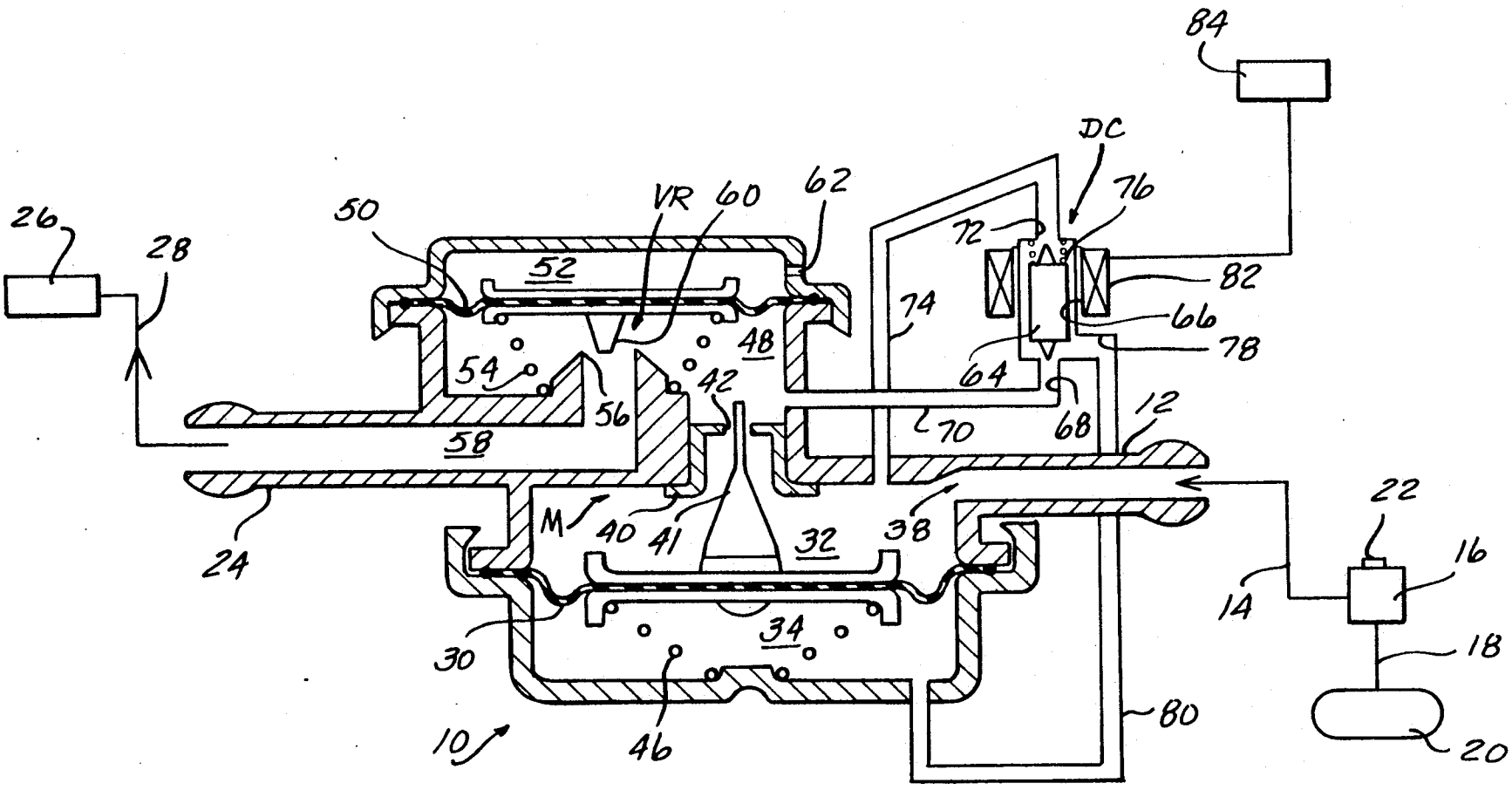
84
82
66
78
76
DC
72
74
62
60
VR
52
50
28
26
12
64
68
70
56
54
58
48
42
24
14
22
16
18
20
80
38
32
34
41
40
M
46
30
10

PURGE VALVE

BACKGROUND OF THE INVENTION

The present invention relates to a purge valve for controlling the flow of fuel vapor from a fuel vapor storage canister carried in a vehicle to the intake manifold of the vehicle engine.

To accommodate the withdrawal of fuel from the fuel tank of a vehicle by operation of the vehicle engine, the head space of the fuel tank must be vented to atmosphere. In the past, a simple vent line opening to atmosphere at a level high enough to prevent fuel from being vented was considered adequate, and no concern was given to the fact that under certain climatic conditions, and during refueling of the tank, a substantial amount of fuel vapor would be discharged from the head space of the tank into the atmosphere. In recent years, so-called on board vapor recovery systems have been produced in which the head space of the fuel tank is vented to a vapor storage canister filled with some vapor absorbent material, such as charcoal, and the resulting mixture of fuel vapor and air is conducted to the intake manifold of the engine for combustion. Because the canister can be purged only when the engine is running, the canister capacity and/or purge rate "schedule" must be such that the canister does not become over-saturated with fuel. This would allow liquid fuel to be conducted to the engine and/or allow fuel vapors to escape to atmosphere. For a given system's canister capacity constraints, the required purge rate could actually become high enough to satisfy an engine's fuel requirements at idle.

It is thus necessary to control or throttle (i.e. modulate) the flow of fuel vapor from a vapor storage canister to the intake manifold of the vehicle engine to avoid over- or under- enriching the fuel mixture supplied to the manifold by the fuel injection system. Purge valves for this purpose which are controlled by the electronic control unit now conventionally employed to control many vehicle operation functions have been developed in the prior art.

Typically, these purge valves include a solenoid actuated on-off valve in the line connecting the vapor storage canister to the manifold. The valve solenoid is cyclicly energized and de-energized by a pulse width modulated control signal generated by the vehicle's electronic control unit in accordance with various engine operating parameters sensed or monitored by the control unit. This type of control is frequently referred to as a duty cycle operation in which the signal received from the control unit opens the valve for a regulated portion of a cycle and closes the valve for the remaining portion of the cycle. The pressure inducing flow of vapor while the valve is open is the pressure differential between substantially atmospheric pressure (the vapor storage canister is vented to atmosphere) and manifold vacuum, which can vary substantially, dependent upon the vehicle engine operating conditions. In U.S. Pat. No. 4,944,276, a purge valve employing a duty cycle operated solenoid valve and a vacuum regulator which establishes a constant flow inducing pressure differential is disclosed.

Duty cycle operation of an on-off valve assumes that the total flow through a valve which is open half the time will be equal to the total flow through the same valve if the valve is held halfway open over an equal time period. This assumption, however, does not take into account the fact that flow through the valve when continuously halfway open is continuous flow at a constant rate, while flow through the valve in a duty cycle operation is a pulsating flow. Tests have shown that when the fuel vapor in the canister is a relatively high mixture, the pulsating vapor flow to the intake manifold under the control of a duty cycle operated on-off valve will generate correspondingly pulsating peaks in an exhaust emission analyzer.

The present invention is directed to a duty cycle controlled purge valve which meters a steady flow of vapor/air from a vapor storage canister to the engine intake manifold at a continuously variable rate.

SUMMARY OF THE INVENTION

A purge valve embodying the present invention consists essentially of three individual valves: a diaphragm actuated vacuum regulator; a diaphragm actuated metering valve; and a three-way duty cycle solenoid actuated valve, all disposed within a single valve housing.

The vacuum regulator valve takes the form of a pressure responsive flexible diaphragm having one side exposed to a first chamber which opens through a flow port to the intake manifold of the vehicle engine. The opposite side of the vacuum regulator valve diaphragm is vented directed to atmosphere or exposed to a chamber normally maintained at atmospheric pressure, and a spring biases the diaphragm against actuating pressure. A valve head carried by the diaphragm cooperates with the flow port to establish a variable restriction which maintains a substantially constant vacuum in the first chamber in the face of variations in intake manifold vacuum.

The metering valve is likewise a diaphragm actuated valve with one side of the diaphragm exposed to a chamber which is in constant fluid communication with the vapor storage canister and hence at substantially atmospheric pressure at all times. An outlet port to this first chamber of the metering valve connects the first chamber of the metering valve to the first chamber of the vacuum regulating valve. A valve head carried by the metering valve diaphragm provides a variable restriction to the metering port in accordance with variations in pressure in a second chamber at the opposite side of the metering valve diaphragm which is connected to the control port of the three-way duty cycle solenoid valve. A spring biases the metering valve in a closing direction.

The three-way duty cycle valve has a first port connected to the first chamber of the regulating valve, this last chamber, as described above, being maintained at a constant sub-atmospheric pressure. A second port of the duty cycle valve is connected to the first chamber of the metering valve which, as described above, is at a constant, substantially atmospheric pressure. The solenoid of the duty cycle valve, when energized, connects its control port to one of the valve supply ports and connects the other of the supply ports to the control port when the solenoid is de-energized. Operation of the duty cycle valve thus varies the pressure in the second chamber of the metering valve to thereby position the metering valve diaphragm valve head to meter the flow of vapor from the canister to the manifold, this flow passing from the first chamber of the metering valve through the metering valve to the first chamber of the regulating valve and thence through the flow port of the regulating valve to the manifold. The increase or decrease of pressure in the variable pressure chamber of the metering valve over any single cycle of the duty cycle operation of the three-way valve is very small. Thus, the metering valve diaphragm does not move significantly unless an imbalance between the pressure and vacuum phases of a duty cycle is maintained over a substantial number of cycles. Hence, the metering valve remains normally at a substantially fixed position to establish a steady rate of flow of vapor. Other objects and features of the invention will become apparent by reference to the following specification and to the drawings.

IN THE DRAWINGS

The single FIGURE of the drawing is a partially schematic cross sectional view of a purge valve embodying the present invention, including a schematic representation of a fuel vapor recovery system in which the valve is employed.

A valve embodying the present invention includes a valve housing designated generally 10 having a first hose coupling 12 establishing an inlet to the housing for connection to a hose 14 connected to a fuel vapor storage canister 16 mounted at some convenient location upon a vehicle. Canister 16 is connected by a conduit 18 to the head space of the vehicle fuel tank 20 so that fuel vapor which accumulates in the head space of tank 20 can pass from the tank into the canister when the vapor pressure in the fuel tank head space exceeds atmospheric pressure. Canister 16 is vented to atmosphere as by a vent 22.

A second hose coupling 24 is formed on housing 10 to provide a connection between the housing and the intake manifold IM of the vehicle engine as by conduit schematically indicated at 28.

A metering valve designated generally M includes metering valve diaphragm 30 which divides a cavity within housing 10 into a first chamber 32 and a second chamber 34. An inlet passage 36 through hose coupling 12 opens into chamber 32 at 38, and chamber 32 is thus in direct fluid communication with vapor storage canister 16 at all times. A metering valve seat 40 is formed with a flow passage 42 which constitutes an outlet of chamber 32. A metering valve head 41 carried by diaphragm 30 is cooperable with metering valve seat 40 and passage 42 to variably restrict flow through passage 42 in accordance with the position of diaphragm 30 relative to housing 10. As shown in the drawing, diaphragm 30 is biased upwardly in a direction tending to close passage 42 by a spring 46. Diaphragm 30 is movable relative to housing 10 in accordance with the pressure differential between chambers 32 and 34, as modified by the biasing action exerted by spring 46. As stated above, chamber 32 is at all times connected to vapor storage canister 16, which is vented to atmosphere, hence the pressure in chamber 32 remains at a pressure equal to or substantially equal to atmospheric pressure at all times. The pressure in chamber 34 may be varied in a manner to be described in greater detail below, the variation in pressure in chamber 34 shifting the metering valve head 41 relative to metering valve seat 40. When the pressure in chamber 32 is substantially equalized with the pressure in chamber 34, diaphragm 30 is biased upwardly by spring 46 to a position such that the metering valve head 41 is seated within valve seat 40 to completely block flow through passage 42 in valve seat 40.

Passage 42, when opened, places chamber 32 of the metering valve in fluid communication with a first chamber 48 of a vacuum regulating valve VR which includes a flexible regulating valve diaphragm 50 having one face exposed to chamber 48 and having its opposite face exposed to a second chamber 52. A regulating valve spring 54 biases diaphragm 50 upwardly as viewed in the drawing.

Chamber 48 of the regulating valve opens through a regulating valve port 56 into a passage 58 through hose coupling 24 which is in fluid communication at all times with the engine intake manifold 26. A regulating valve head 60 carried by diaphragm 50 is shiftable, in accordance with the position of diaphragm 50 to selectively open or close valve port 56. In the embodiment of the invention shown in the drawing, chamber 52 of the regulating valve is vented to atmosphere as by port 62 and is thus maintained at atmospheric pressure. As an alternative, port 62 could be connected to chamber 32 to avoid external fuel leakage and to improve valve flow under low engine vacuum conditions. As stated above, the vacuum or subatmospheric pressure of the engine intake manifold 26 will vary in accordance with the engine speed and load, and by varying the opening of the regulating valve port 56 by flexing of diaphragm 50, chamber 48 is maintained at a substantially constant subatmospheric pressure whose magnitude is determined by the biasing force of spring 54.

In addition to metering valve M and the vacuum regulating valve VR, a third solenoid actuated three-way valve designated generally DC is mounted in housing 10. Valve DC is shown schematically in the drawing and includes a double-ended valve head member 64 slidably received within a central passage 66. Valve head 64 is movable between a supply valve seat 68 which opens through a passage 70 into chamber 48 of the vacuum regulating valve VR and a vent valve seat 72 opening through a vent port or passage 74 into chamber 32 of metering valve M. Valve head 64 is normally biased into seated engagement with valve seat 68 by spring 76. A third or control port 78 of valve DC opens into passage 66 and communicates with chamber 34 of the metering valve M via a passage 80 through housing 10.

The solenoid 82 of valve DC is electrically connected to receive a pulse width modulated or duty cycle signal from an electronic control unit 84 which monitors appropriate vehicle operating conditions and is programmed to generate appropriate pulse width modulated control signals to cyclicly energize and de-energize the solenoid of valve DC. When solenoid 82 is de-energized, spring 76 biases valve head 64 into seated engagement with valve seat 68 to seal passage 66 of the valve from the subatmospheric pressure existing in chamber 48 of the vacuum regulator valve VR, leaving valve head 64 disengaged from the opposite seat 72, thereby placing chamber 32, which is at atmospheric pressure, in communication with chamber 34 of the metering valve via passage 74, passage 66, control outlet port 78 and passage 80. When solenoid 82 is energized, valve head 64 is shifted to open port 70 and to seat against valve seat 72 to block port 74. When valve had 64 is in this last position, chamber 34 of the metering valve M is placed in communication with the subatmospheric pressure in chamber 48 of the vacuum regulator valve VR via the opened port 70, passage 66 of the valve DC, control port 78 of valve DC and passage 80.

The electronic control unit 84 and the manner in which it is programmed is well-known in the art, as is the duty cycle operation of a three-way solenoid actuated valve such as the valve DC. In brief, the electronic control unit transmits to the solenoid cyclic signals and within each signal cycle the solenoid is energized for a portion of that cycle determined by the control unit, and is de-energized for the remainder of that cycle. Where the signal is employed to control a three-way valve, as in the present case, one supply port, in this case port 70 is maintained at a constant low pressure, while a second port, in this case port 74, is maintained at a constant higher pressure. If the cyclic signal transmitted from the control unit to the solenoid energizes the solenoid for one half of the cycle and de-energizes the solenoid for the other half of the cycle, after a series of similar cycles have occurred, the pressure at the third control port will stabilize at a pressure equal to the arithmetic average of the pressure at the first port and the pressure at the second port. Pressure at the control port may be decreased by increasing the percentage of the cycle during which the solenoid is energized or may be increased by increasing the percentage of time that the solenoid is de-energized. If the solenoid is de-energized throughout the cycle, the control port will remain connected, in the present case, to atmospheric pressure via the opened port 74 and after a sufficient period of time, the pressures in chambers 32 and 34 of the metering valve will become equalized and the valve will close to seal the metering valve port 42 by virtue of the spring bias of spring 46.

Typical duty cycle frequencies are of the order of thirty cycles per second, and thus the incremental increase or decrease in pressure in chamber 34 over one cycle is so small as to have no significant effect in shifting or moving diaphragm 30 in flow metering movement. Adjustment of the position of the diaphragm in flow metering movement requires the persistence of a signal over several cycles. However, closure of the metering valve to stop the flow of vapor to the intake manifold may be accomplished reasonably rapidly simply by maintaining solenoid 82 de-energized for a period of time sufficient for continuous flow of pressure from chamber 32 through the valve into chamber 34 to increase the pressure in chamber 34 to a point where this pressure, augmented by the spring force of spring 46 will close the metering valve.

The vacuum regulating valve VR normally is maintained in a partially open position by the regulating spring 54 and will shift slightly to establish a larger or smaller opening in response to variations in the vacuum induced in the intake manifold. Essentially, the subatmospheric pressure in chamber 48 remains at a constant subatmospheric pressure determined by the spring force exerted by spring 54 on diaphragm 50. Thus, during normal engine operation, the cross sectional flow area through metering port 42 established by the metering valve M remains substantially constant, or is varied reasonably slowly, because the pressure differential between atmospheric pressure in chamber 32 and the regulated subatmospheric pressure in chamber 48 which induces flow through the metering valve remains substantially constant, hence a smooth continuous rate of flow of vapor through the metering valve is achieved.

While one embodiment of the invention has been described in detail, it will be apparent to those skilled in the art the disclosed embodiment may be modified. Therefore, the foregoing description is to be considered exemplary rather than limiting, and the true scope of the invention is that defined in the following claims.

What is claimed:

1. A purge valve for controlling the flow of vapor from a vapor source at atmospheric pressure to a vacuum source at which the absolute pressure is variable, said purge valve comprising a housing having a first chamber in constant fluid communication with said vapor source, said housing having a second chamber communicating with said vacuum source via a regulating port and communication with said first chamber via a metering port, metering valve means for metering the flow of vapor from said first chamber to said second chamber via said metering port in response to the differential between the pressure in said first chamber and a variable pressure in a third chamber in said housing, regulating valve means for adjustably metering the flow of vapor from said second chamber to said vacuum source via said regulating port in response to the differential between the pressure in said second chamber and the atmospheric pressure, and duty cycle controlled valve means for varying the pressure in said third chamber said duty cycle controlled valve means having a first port opening into said first chamber, a second port opening into said second chamber, and a third port opening into said third chamber, actuable valve means movable between a first position and a second position to connect one of said first and second ports to said third port in said first position and to connect the other of said first and second ports to said third port in said second position, and means for alternately actuating said actuable valve means between said first and second positions.

2. The invention defined in claim 1 wherein said regulating means includes means for maintaining the pressure in said second chamber at a substantially constant subatmospheric pressure.

3. The invention defined in claim 1 wherein said vapor source comprises a storage canister for storing fuel vapor discharged from the head space of the fuel tank of a vehicle, and said vacuum source comprises the intake manifold of the vehicle engine.

4. The invention defined in claim 1 wherein said metering valve means comprises a flexible diaphragm defining a movable wall disposed between said first and third chamber, spring means biassing said diaphragm toward said metering port and a metering valve head mounted on said diaphragm within said first chamber movable with said diaphragm toward and away from said metering port to variably restrict flow through said metering port, and operable when at an end limit of movement toward said metering port to completely block flow through said port.

5. A purge valve for controlling the flow of fuel vapor from a fuel vapor storage canister of a motor vehicle to the intake manifold of the vehicle engine, said purge valve comprising a housing having a first chamber therein communicating with said manifold via a first outlet port, vacuum regulating means for maintaining said first chamber at a substantially constant subatmospheric pressure in the face of manifold vacuum variations, means defining a second chamber in said housing in unrestricted fluid communication with said canister at all times, said second chamber having a metering port opening into said first chamber, flexible metering diaphragm means exposed at one side to said second chamber and exposed at its opposite side to a third chamber in said housing for movement toward and away from said metering port in response to variations in the pressure differential between said second and third chambers to meter flow through said metering port in accordance with said pressure differential, three-way valve means in said housing having a first port opening into said first chamber, a second port opening into said second chamber and a third port opening into said third chamber, and duty cycle signal controlled valve actuating means for alternately shifting said three-way valve means between a first position connecting said third port to said first port and a second position connecting said third port to said second port to vary the pressure in said third chamber in accordance with variations of a duty cycle signal.

6. The invention defined in claim 5 wherein said vacuum regulating means comprises a flexible diaphragm having one side exposed to said first chamber and having its opposite side exposed to atmosphere.

7. The invention defined in claim 5 wherein said vacuum regulating means comprises a flexible diaphragm having one side exposed to said first chamber and having its opposite side exposed to said second chamber.

* * * * *